US008646230B2

(12) United States Patent
Powers, III

(10) Patent No.: US 8,646,230 B2
(45) Date of Patent: Feb. 11, 2014

(54) FLAT ROOF SUPPORT STRUCTURE

(76) Inventor: John Powers, III, Phoenix, AZ (US)

( * ) Notice: Subject to any disclaimer, the term of this patent is extended or adjusted under 35 U.S.C. 154(b) by 0 days.

(21) Appl. No.: 13/462,919

(22) Filed: May 3, 2012

(65) Prior Publication Data

US 2012/0304593 A1 Dec. 6, 2012

Related U.S. Application Data

(60) Provisional application No. 61/481,747, filed on May 3, 2011.

(51) Int. Cl.

| | |
|---|---|
| ***E04B 7/00*** | (2006.01) |
| ***E04B 1/00*** | (2006.01) |
| ***E04B 1/08*** | (2006.01) |
| *E04D 5/14* | (2006.01) |

(52) U.S. Cl.

CPC .. *E04B 1/08* (2013.01); *E04D 5/148* (2013.01)
USPC ..... 52/262; 52/746.11

(58) Field of Classification Search

USPC ..... 52/262, 261, 263, 264, 848, 702, 648.1, 52/651.03, 651.07, 651.08, 653.1, 653.2, 52/831, 836, 843, 845

See application file for complete search history.

(56) References Cited

U.S. PATENT DOCUMENTS

| | | | | |
|---|---|---|---|---|
| 5,921,053 | A * | 7/1999 | Callahan et al. | 52/843 |
| 7,316,098 | B1 * | 1/2008 | Sackett | 52/92.2 |
| 7,707,795 | B2 * | 5/2010 | Yu et al. | 52/657 |
| 7,721,476 | B2 * | 5/2010 | Tumlinson et al. | 40/607.05 |
| 2005/0252149 | A1 * | 11/2005 | Ritchey et al. | 52/648.1 |
| 2007/0163204 | A1 * | 7/2007 | Ceba et al. | 52/741.1 |
| 2007/0209314 | A1 * | 9/2007 | Vaughn | 52/720.1 |
| 2008/0256884 | A1 * | 10/2008 | Clarizia et al. | 52/309.3 |
| 2010/0031600 | A1 * | 2/2010 | Nakagawa et al. | 52/653.1 |
| 2010/0043341 | A1 * | 2/2010 | Staley | 52/702 |
| 2011/0308190 | A1 * | 12/2011 | Pryor et al. | 52/653.1 |

* cited by examiner

*Primary Examiner* — William Gilbert
*Assistant Examiner* — Kyle Walraed-Sullivan
(74) *Attorney, Agent, or Firm* — Parsons & Goltry; Robert A. Parsons; Michael W. Goltry

(57) ABSTRACT

A flat roof support structure includes a plurality of vertical columns, an elongated generally horizontally oriented beam associated with and positioned atop each vertical column, and attachment structure fixing the upper end of each vertical column to a mounting area of the associated elongated beam. The attachment structure includes U-shaped attachment members affixed to opposed sides of the vertical columns at the upper end of each column with the attachment members opening in an outwardly directed orientation parallel to the associated elongated beam. A pair of attachment plates is fixed to opposed sides of each elongated beam in the mounting area. The attachment plates extend downwardly below a lower surface of the elongated beam a distance equal to a portion of the U-shaped attachment members so as to overlap the portion. Attachment devices fix the attachment plates to the U-shaped attachment members and are assembled on-site.

18 Claims, 12 Drawing Sheets

FLAT ROOF SUPPORT STRUCTURE

CROSS-REFERENCE TO RELATED APPLICATION

This application claims the benefit of U.S. Provisional Patent Application No. 61/481,747, filed 3 May 2011.

FIELD OF THE INVENTION

This invention generally relates to supporting systems for flat roof structures.

BACKGROUND OF THE INVENTION

At the present time, flat roof structures include steel posts having steel beams affixed to the tops thereof by some method such as welding. In most instances these structures are relatively large and must be assembled at the site. Fixing the steel posts and steel beams by welding at the site is very difficult and inconvenient. First, the welding equipment, which is generally electric, requires large amounts of electrical power, is expensive to provide at the site, and requires special personnel to operate. Second, the government requires special inspectors on hand, at the site to inspect every weld as it is made. These inspectors must be paid for by the company doing the construction. Further, in many instances the welds must be relatively large or long and are relatively expensive without even considering the expenses mentioned above.

It would be highly advantageous, therefore, to remedy the foregoing and other deficiencies inherent in the prior art.

Accordingly, it is an object of the present invention to provide a new and improved flat roof structure that can be easily bolted together at the site and does not require any on-site welding.

It is another object of the present invention to provide a new and improved flat roof structure that is relatively simple and inexpensive to install.

It is another object of the present invention to provide a new and improved flat roof structure that does not require welding equipment and other special tools on-site to install.

SUMMARY OF THE INVENTION

Briefly, to achieve the desired objects of the instant invention in accordance with a preferred embodiment thereof, a flat roof support structure is provided that includes a plurality of vertical columns, an elongated generally horizontally oriented beam associated with and positioned atop each vertical column, and attachment structure fixing the upper end of each vertical column to a mounting area of the associated elongated beam. The attachment structure includes U-shaped attachment members affixed to opposed sides of the vertical columns at the upper end of each column with the attachment members opening in an outwardly directed orientation parallel to the elongated beam. At least one attachment plate is fixedly attached to one side of each elongated beam in the mounting area. The attachment plate extends downwardly below a lower surface of the elongated beam a distance equal to at least a portion of the U-shaped attachment members so as to overlap the portion. Attachment devices fix the at least one attachment plate to the U-shaped attachment members and are assembled on-site.

The desired objects of the instant invention are further achieved in accordance with a method of providing and assembling a flat roof support structure including the steps of providing a plurality of vertical columns and providing an elongated generally horizontally oriented beam associated with and adapted to be positioned atop each vertical column. The method further includes the off-site steps of affixing U-shaped attachment members to opposed sides of the vertical columns at the upper end of each column with the attachment members opening in an outwardly directed orientation parallel to the elongated beam and affixing at least one attachment plate to one side of each elongated beam in a mounting area. A portion of the attachment plate extends downwardly below a lower surface of the elongated beam a distance equal to at least a portion of the U-shaped attachment members. The method further includes the on-site steps of assembling the plurality of vertical columns and the associated generally horizontally oriented beams by mounting each column of the plurality of vertical columns in an upright fixed orientation and positioning the associated beams with the mounting area above the upper end of the column so that the downwardly extending portion of the attachment plate overlaps the at least a portion of the U-shaped attachment members and using attachment devices affixing the overlapping portion of the attachment plate to the U-shaped attachment members in the mounting area of each vertical column and associated generally horizontally oriented beam, whereby the beams and columns are fixedly attached on-site without welding.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
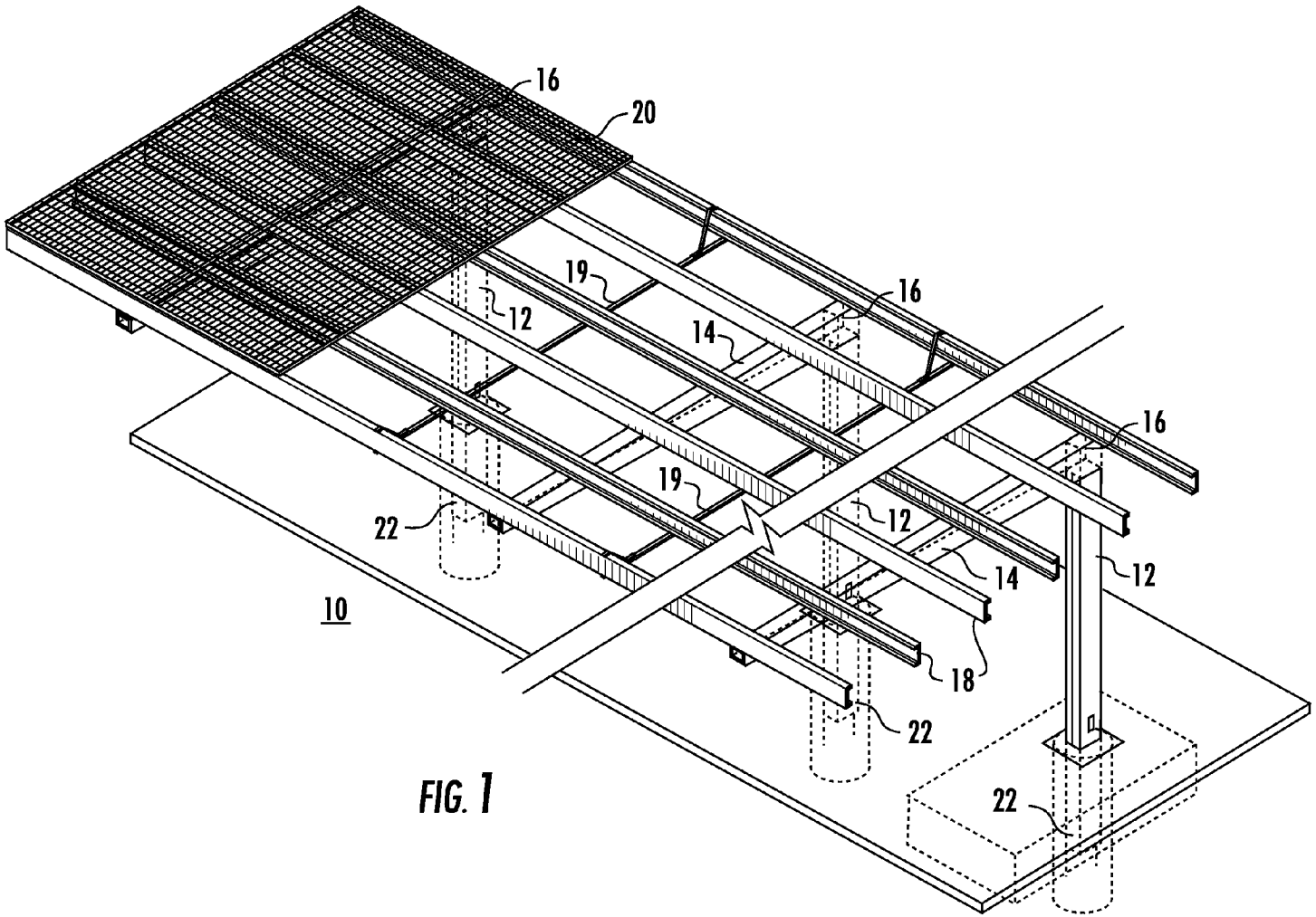
FIG. 1 is an isometric top view of a flat, cantilevered multi-column structure, in accordance with the present invention.
Figure 2:
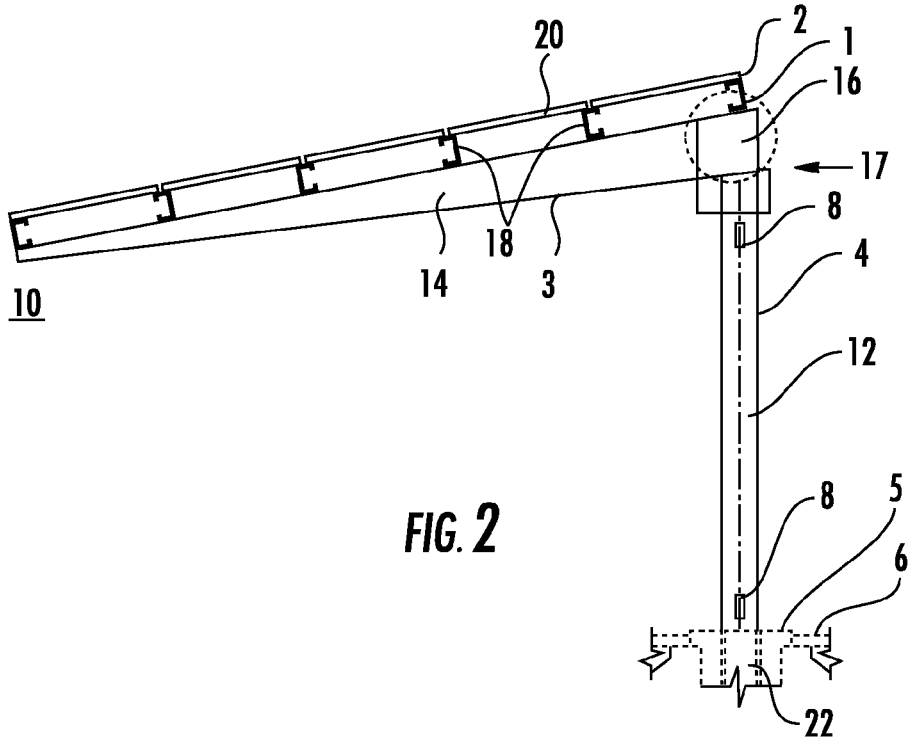
FIGS. 2 and 3 are side views of the solar support structure of FIG. 1 with different slopes.
Figure 3:
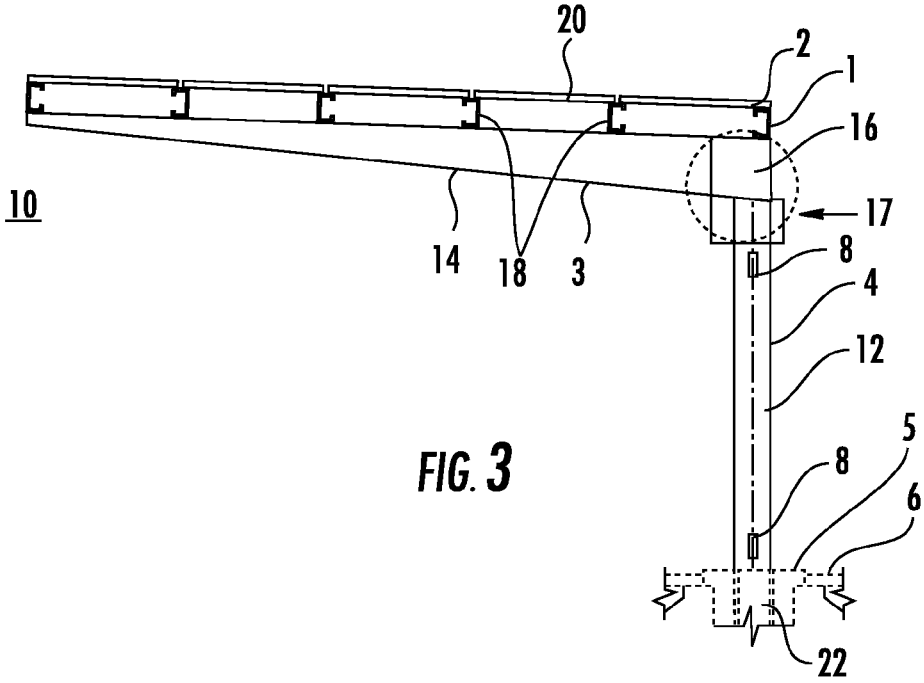

Turning now to FIGS. 1-3, a flat, cantilevered multi-column structure 10, in accordance with the present invention, is illustrated. Structure 10 includes a plurality of vertical columns or posts 12 each with a cantilever beam 14 attached to an upper end 16. A plurality of purlins 18 are affixed to an upper surface of beams 14 and positioned to extend longitudinally in parallel spaced apart relationship to substantially define the roof area. Additional purlin braces 19 can be incorporated between cantilever beams 14 for additional support if desired or deemed necessary. Some roofing material or flat sections 20 are attached to the upper surface of purlins 18 to form a complete roof. One example of roofing material or flat sections that can be used for sections 20 is provided in copending United States Patent Application entitled "Solar Support Structure", bearing Ser. No. 13/036,858, filed on 28 Feb. 2011, and incorporated herein by reference.

For purposes of this disclosure it should be understood that structure 10 is chiefly assembled at the site and it is highly desirable that each step of the assembly procedure be as simple as possible. Basically, each of the components mentioned above (i.e. column 12, beams 14, purlins 18, and roof sections 20) are provided as individual items from an off-site factory/shop and assembled on site into structure 10. By providing the items separately each item can be relatively easily handled by workmen conveying the items to the site and by workmen doing the assembling at the site. At this point it is important to understand that no welding is performed at the site since that would require substantial additional equipment and electrical power, as well as government inspectors on site at substantial additional cost.

Briefly, the assembly procedure includes fixing a lower end 22 of each column 12 in the ground or in a base that serves as the ground. One end of a cantilever beam 14 is affixed to the upper end 16 of each column 12 by structure that will be explained in detail below. Cantilever beams 14 and the structure affixing them to ends 16 of columns 12 are pre-designed to provide a desired slope to the roof. For example, the slope may be at any desired degree from a downward slope of 10° as illustrated in FIG. 2 to an upward slope of 10° as illustrated in FIG. 3. With cantilever beams 14 fixedly attached, purlins 18 are attached to the upper surface of cantilever beams 14 in a direction perpendicular to cantilever beam 14. At this point additional purlin braces 19 can be affixed to purlins 18 between cantilever beams 14 if desired or deemed necessary. Roof sections 20 are then attached to the upper surfaces of purlins 18 in any well known manner (see for example the structure disclosed in the above identified copending patent application) and using any well known attachment devices such as screws, bolts, etc.

Figure 4:
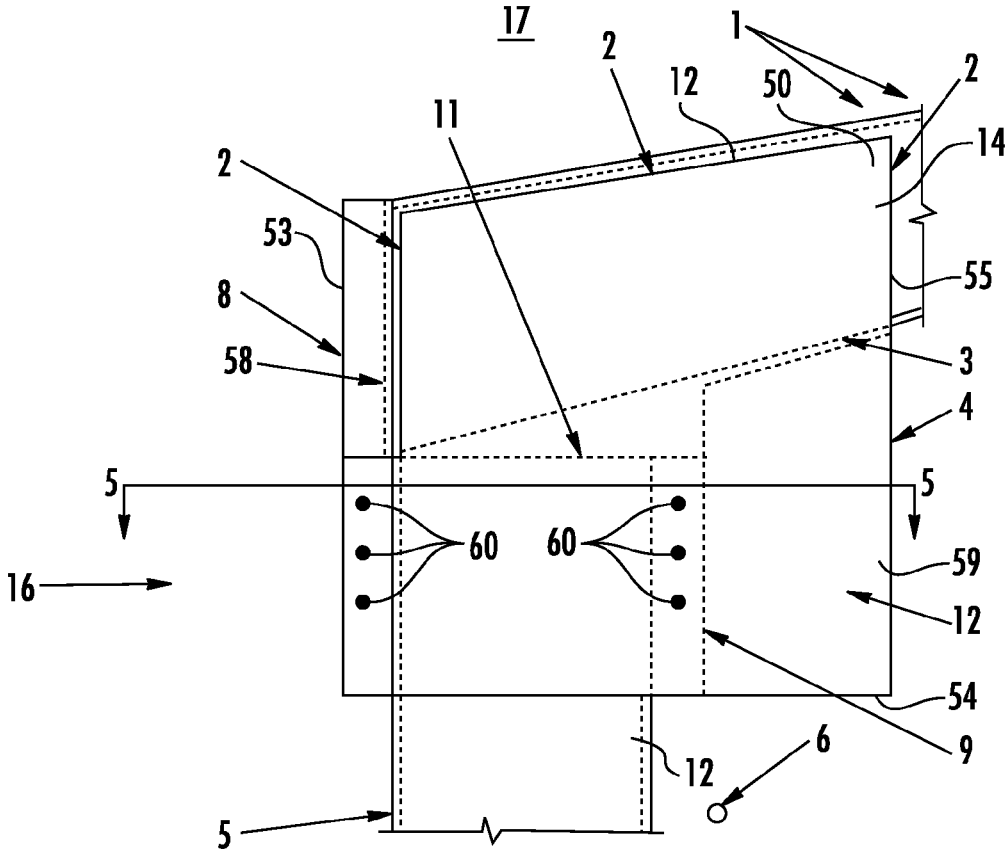
FIG. 4 is an enlarged sectional side view of a column and beam structural area of the cantilevered structure of FIG. 1, illustrating the column and beam mounting structure in detail.
Figure 5:
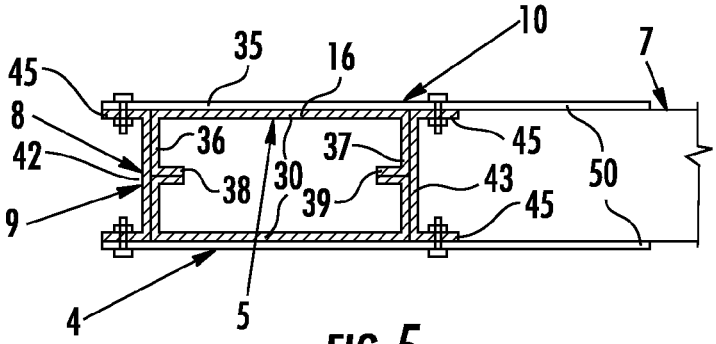
FIG. 5 is a sectional view of the column and beam structural area as seen from the line 5-5 in FIG. 4.

Referring additionally to FIGS. 4 and 5, specific attachment structure, generally designated 17, for affixing one end of a cantilever beam 14 to the upper end of a column 12 without using any welding is disclosed. In this specific embodiment each column 12 is formed by affixing two elongated channels 30 together in abutting relationship, for example by welding, bolting, etc. Each channel 30 is preformed in the factory/shop with a major wall 35, two side walls 36 and 37 extending perpendicular to wall 35 from opposite edges and flanges 38 and 39 extending inwardly toward each other perpendicular to side walls 36 and 37. As a typical example and for purposes of explanation, each beam 30 is formed from a flat stock of 20 gauge steel with major wall 35 being 8 inches wide, side walls 36 and 37 each being 2½ inches wide and flanges 38 and 39 each being 1 inch wide. Referring to FIG. 5, it can be seen that each column 12 is formed by affixing two beams 30 together by attaching flanges 38 and 39 of each beam 30 in abutting relationship, for example by welding, bolting, etc.

Short section of U-shaped attachment members 42 and 43 are affixed to side walls 36 and 37, respectively, at upper end 16 of each column 12. In this specific, example members 42 and 43 are approximately 15 inches long and are attached to column 12 by pre-welding at the factory/shop with the U-shape opening outwardly to form four attachment flanges 45, one at each corner of column 12. U-shaped attachment members 42 and 43 may be preformed in the factory/shop in a manner and from materials similar to that described above for channels 30. For example, each U-shaped member has a major wall approximately 5 inches wide and side walls approximately 3 inches wide.

A pair of attachment plates 50 is fixedly attached to opposed sides of the mounted end (i.e. the mounting area) of each cantilever beam 14 by welding in the factory/shop. Each attachment plate 50 is generally rectangular in shape with an upper edge 52 that may be angled to match the upper surface of cantilever beam 14, a left edge 53 (as seen in FIG. 4) that matches or is aligned with the outer edge of flange 45 of U-shaped attachment member 42, a lower edge 54 that extends down to approximately the lower edges of flanges 45, and a right edge 55 that is positioned a substantial distance (e.g. 6" to 10") along cantilever beam 14 or spaced from left edge 53. Attachment plates 50 are each fixedly attached, in this specific example, by welding along the upper edge 52 and an adjacent and coextensive portion of the upper surface of cantilever beam 14. Also, a coextensive portion of edge 53 of each attachment plate 50 is welded to the fixed or mounted end of cantilever beam 14 along an edge designated 58. Basically, any and/or all common joints or edges between cantilever beam 14 and each attachment plate 50 can be welded if deemed desirable and efficient. Thus, attachment plates 50 form a solid channel or box into which the upper end 16 of column 12 can be inserted. An area designated 59 and stippled (shaded) in FIG. 4 can be removed or cut to any desired shape or design as desired, since it has no specific load bearing qualities.

A plurality of spaced apart bolt holes 60 are formed through each attachment plate 50 and through flanges 45 of U-shaped attachment members 42 and 43. In this specific example and for maximum strength bolt holes 60 in each flange 45 are spaced approximately three inches apart and approximately six inches from the lower edge 54 of attachment plates 50. It will be understood that bolt holes 60 can most efficiently be drilled or otherwise formed in the factory/shop, however, they can be formed or drilled by the workers during assembly if preferred. While bolts are preferred for attaching plate 50 to attachment members 42 and 43, it will be understood that other "attachment devices" easily attached at the scene with normal hand-operated tools (as opposed to welding) can be used. Such "attachment devices" may include for example, bolts, screws, rivets, and other mechanically locking devices.

Figure 6:
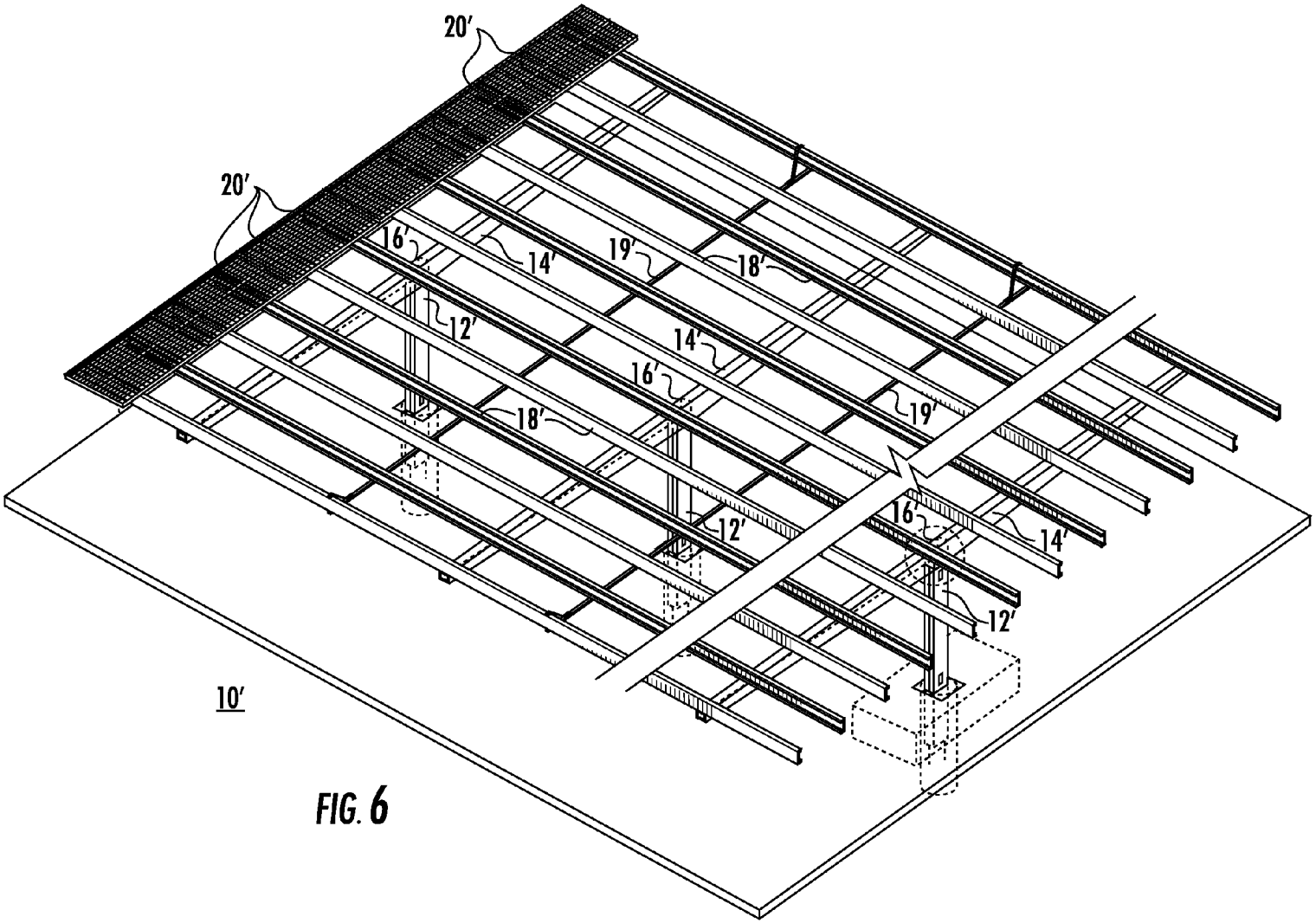
FIG. 6 is an isometric top view of a flat, T-section multi-column structure, in accordance with the present invention.
Figure 7:
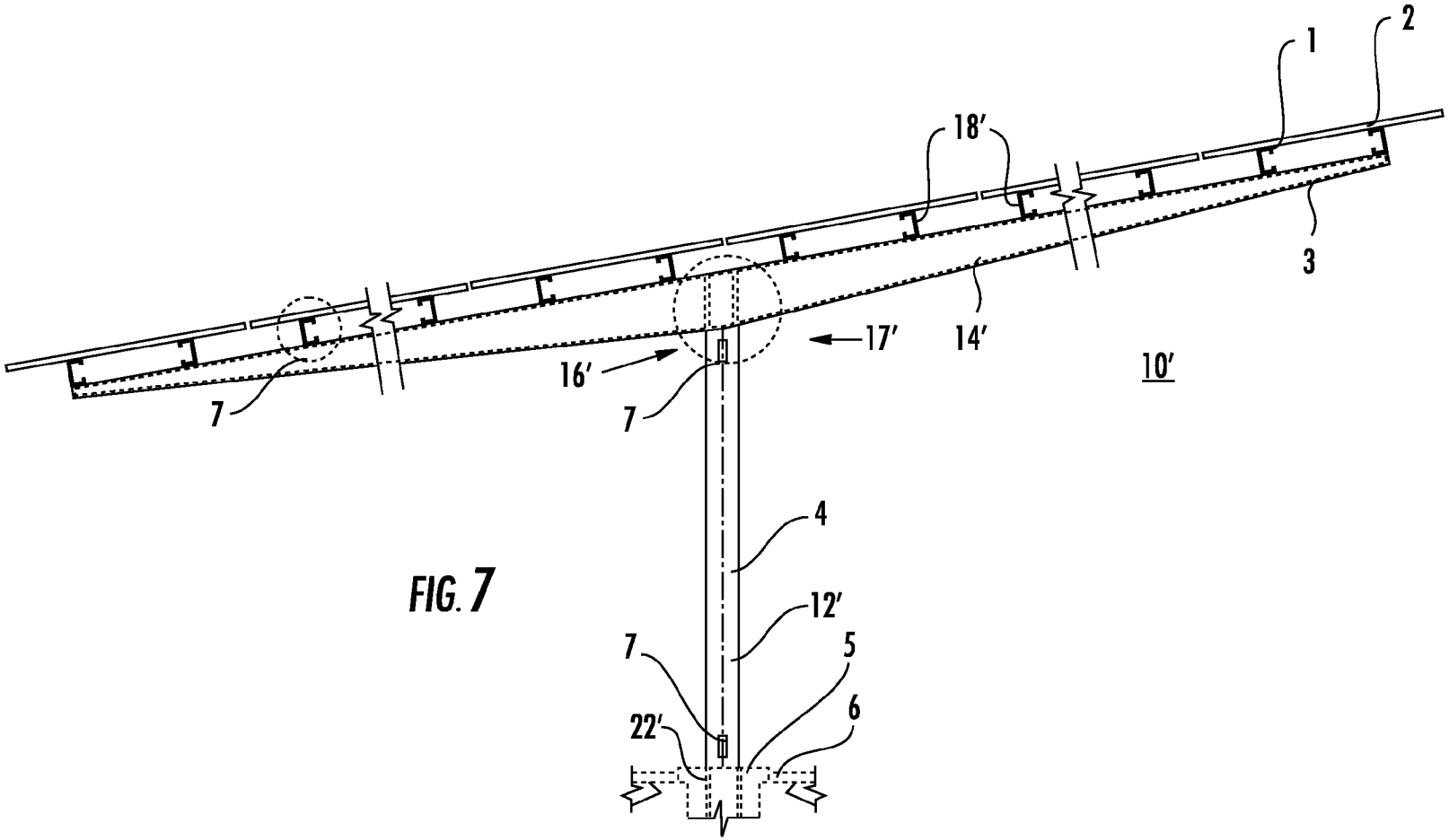
FIG. 7 is a side sectional view of the flat, T-section structure of FIG. 6.

Turning now to FIGS. 6 and 7, a flat, T-section multi-column structure 10', in accordance with the present invention, is illustrated. Structure 10' includes a plurality of vertical columns or posts 12' each with a beam 14' attached to an upper end 16' in a T-shaped orientation with attachment structure, generally designated 17'. A plurality of purlins 18' are affixed to an upper surface of beams 14' and positioned to extend longitudinally in parallel spaced apart relationship to substantially define the roof area. Additional purlin braces 19 can be incorporated between cantilever beams 14' for additional support if desired or deemed necessary. Some roofing material or flat sections 20' are attached to the upper surface of purlins 18' to form a complete roof. Beams 14' and the structure affixing them to ends 16' of columns 12' are pre-designed to provide a desired slope, generally a maximum of 10° as illustrated in FIG. 7, to the roof. For purposes of this disclosure it should be understood that structure 10' is chiefly assembled at the site and it is highly desirable that each step of the assembly procedure be as simple as possible. Basically, each of the components mentioned above (i.e. column 12', beams 14', purlins 18', and roof sections 20') are provided as individual items from a factory/shop and assembled on site into structure 10'. By providing the items separately each item can be relatively easily handled by workmen conveying the items to the site and by workmen doing the assembling at the site. At this point it is important to understand that no welding is performed at the site since that would require substantial additional equipment and electrical power, as well as government inspectors on site at substantial additional cost.

Briefly, the assembly procedure includes fixing a lower end 22' of each column 12' in the ground or in a base that serves as the ground. An attachment portion of a T-section beam 14' is affixed to the upper end 16' of each column 12' by attachment structure 17' that will be explained in detail below. T-section beams 14' and the structure affixing them to ends 16' of columns 12' are pre-designed to provide a desired slope to the roof. With T-section beams 14' fixedly attached, purlins 18' are attached to the upper surface of T-section beams 14' in a direction perpendicular to T-section beam 14'. At this point additional purlin braces 19' can be affixed to purlins 18' between T-section beams 14' if desired or deemed necessary. Roof sections 20' are then attached to the upper surfaces of purlins 18' in any well known manner (see for example the structure disclosed in the above identified copending patent application) and using any well known attachment devices such as screws, bolts, etc.

Figure 8:
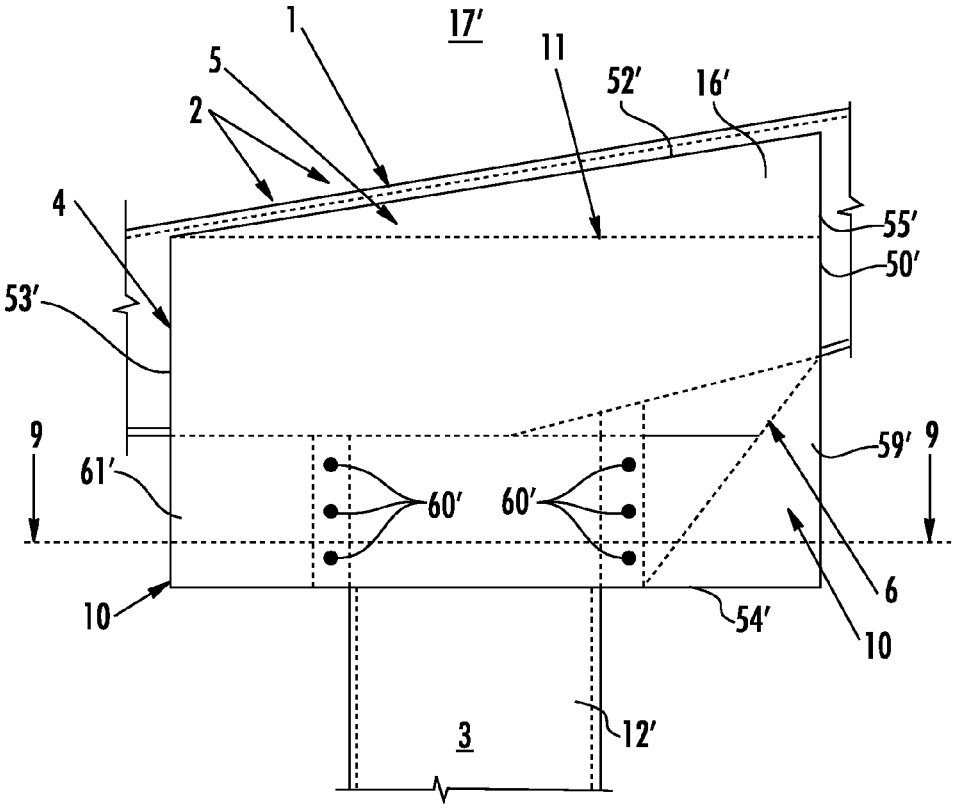
FIG. 8 is an enlarged sectional side view of the column and beam structural area of the T-section structure of FIG. 6, illustrating the column and beam mounting structure in detail.
Figure 9:
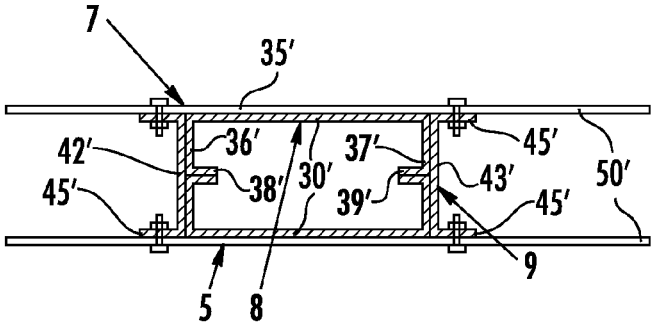
FIG. 9 is an enlarged sectional view of the column and beam structural area of the T-section structure as seen from the line 9-9 of FIG. 8.

Referring additionally to FIGS. 8 and 9, specific attachment structure 17' for affixing the mounting area of a T-section beam 14' to the upper end 16' of a column 12' without using any welding is disclosed. In this specific embodiment each column 12' is formed by affixing two elongated channels 30' together in abutting relationship, for example by welding, bolting, etc. Each channel 30' is preformed in the factory/shop with a major wall 35', two side walls 36' and 37' extending perpendicular to wall 35' from opposite edges and flanges 38' and 39' extending inwardly toward each other perpendicular to side walls 36' and 37'. As a typical example and for purposes of explanation, each beam 30' is formed from a flat stock of 20 gauge steel with major wall 35' being 8 inches wide, side walls 36' and 37' each being 2½ inches wide and flanges 38' and 39' each being 1 inch wide. Referring to FIG. 9, it can be seen that each column 12' is formed by affixing two beams 30' together by attaching flanges 38' and 39' of each beam 30' in abutting relationship, for example by welding, bolting, etc.

Short sections of U-shaped attachment members 42' and 43' are affixed to side walls 36' and 37', respectively, at upper end 16' of each column 12'. In this specific, example members 42' and 43' are approximately 15 inches long and are attached to column 12' by pre-welding at the factory/shop with the U-shape opening outwardly to form four attachment flanges 45', one at each corner of column 12'. U-shaped attachment members 42' and 43' may be preformed in the factory/shop in a manner and from materials similar to that described above for channels 30'. For example, each U-shaped member has a major wall approximately 5 inches wide and side walls approximately 3 inches wide.

A pair of attachment plates 50' is fixedly attached to opposed sides of the mounted end of each T-section beam 14' by welding in the factory/shop. Each attachment plate 50' is generally rectangular in shape with an upper edge 52' that may be angled to match the upper surface of T-section beam 14', a left edge 53' (as seen in FIG. 8) that extends a substantial distance (e.g. ten inches or more) beyond the left edges of flanges 45' of U-shaped attachment member 42', a lower edge 54' that extends down to approximately the lower edges of flanges 45', and a right edge 55' that extends a substantial distance (e.g. ten inches or more) beyond the right edges of flanges 45' of U-shaped attachment member 43'. Attachment plates 50' are each fixedly attached, in this specific example, by welding along the upper edge 52' and an adjacent and coextensive portion of the upper surface of T-section beam 14'. Basically, any and/or all common joints or edges between T-section beam 14' and each attachment plate 50' can be welded if deemed desirable and efficient. Thus, attachment plates 50' form a solid channel or box into which the upper end 16' of column 12' can be inserted. Areas designated 59' and 61' on both sides of column 12' and below T-section beam 16' and stippled (shaded) in FIG. 8 can be removed or cut to any desired shape or design as desired, since they have no specific load bearing qualities.

A plurality of spaced apart bolt holes 60' are formed through each attachment plate 50' and through flanges 45' of U-shaped attachment members 42' and 43'. In this specific example and for maximum strength bolt holes 60' in each flange 45' are spaced approximately three inches apart and a short distance from the lower edge 54' of attachment plates 50'. It will be understood that bolt holes 60' can most efficiently be drilled or otherwise formed in the factory/shop, however, they can be formed or drilled by the workers during assembly if preferred.

Figure 10:
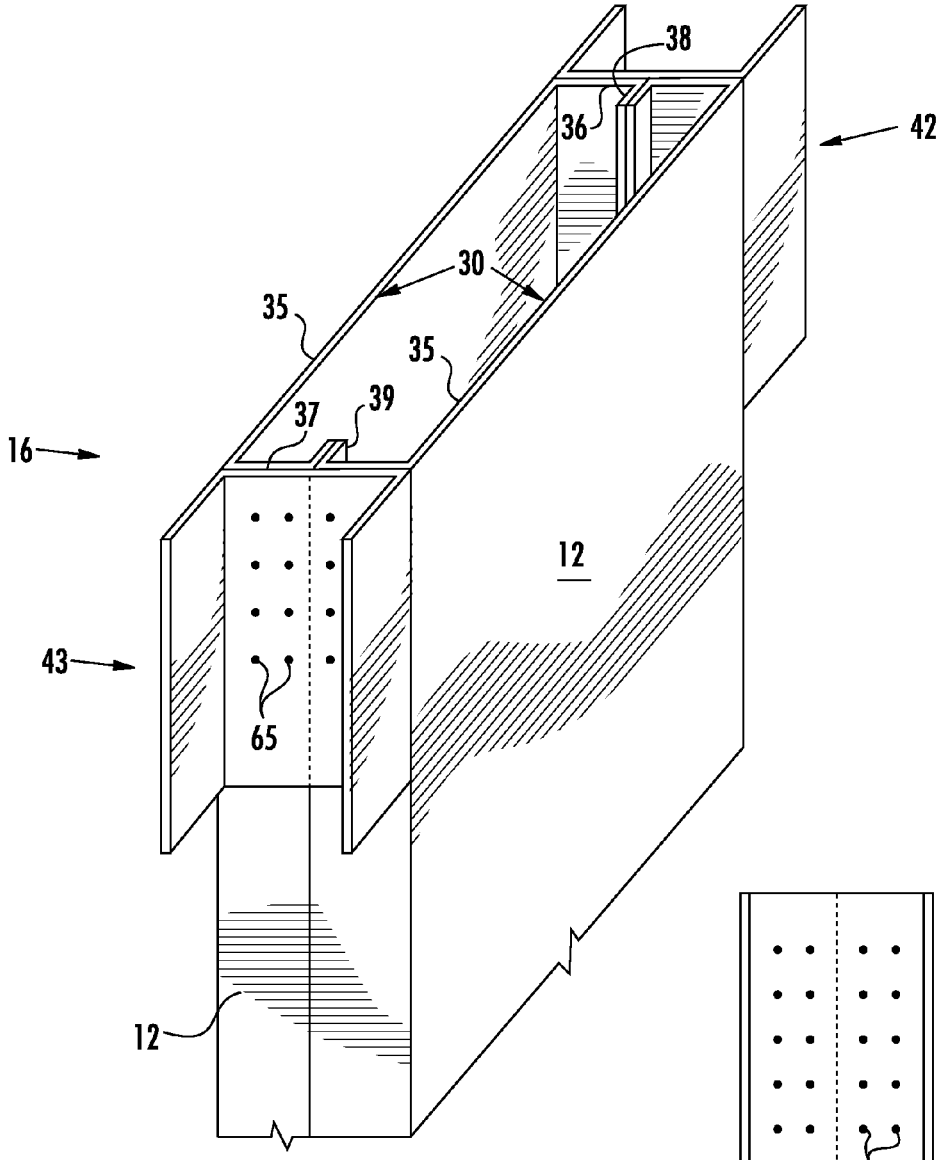
FIG. 10 is an isometric top view of one end of a column as used in either the cantilevered structure of FIG. 1 or the T-section structure of FIG. 6.
Figure 11:
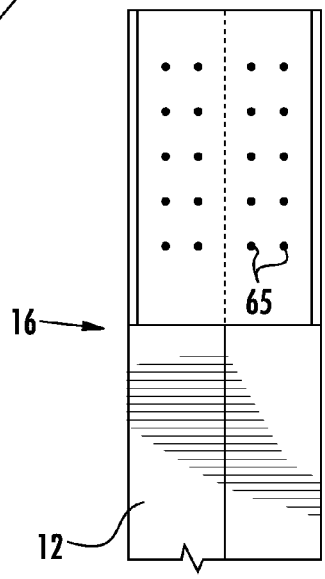
FIG. 11 is a side view of the end of the column of FIG. 10.
Figure 12:
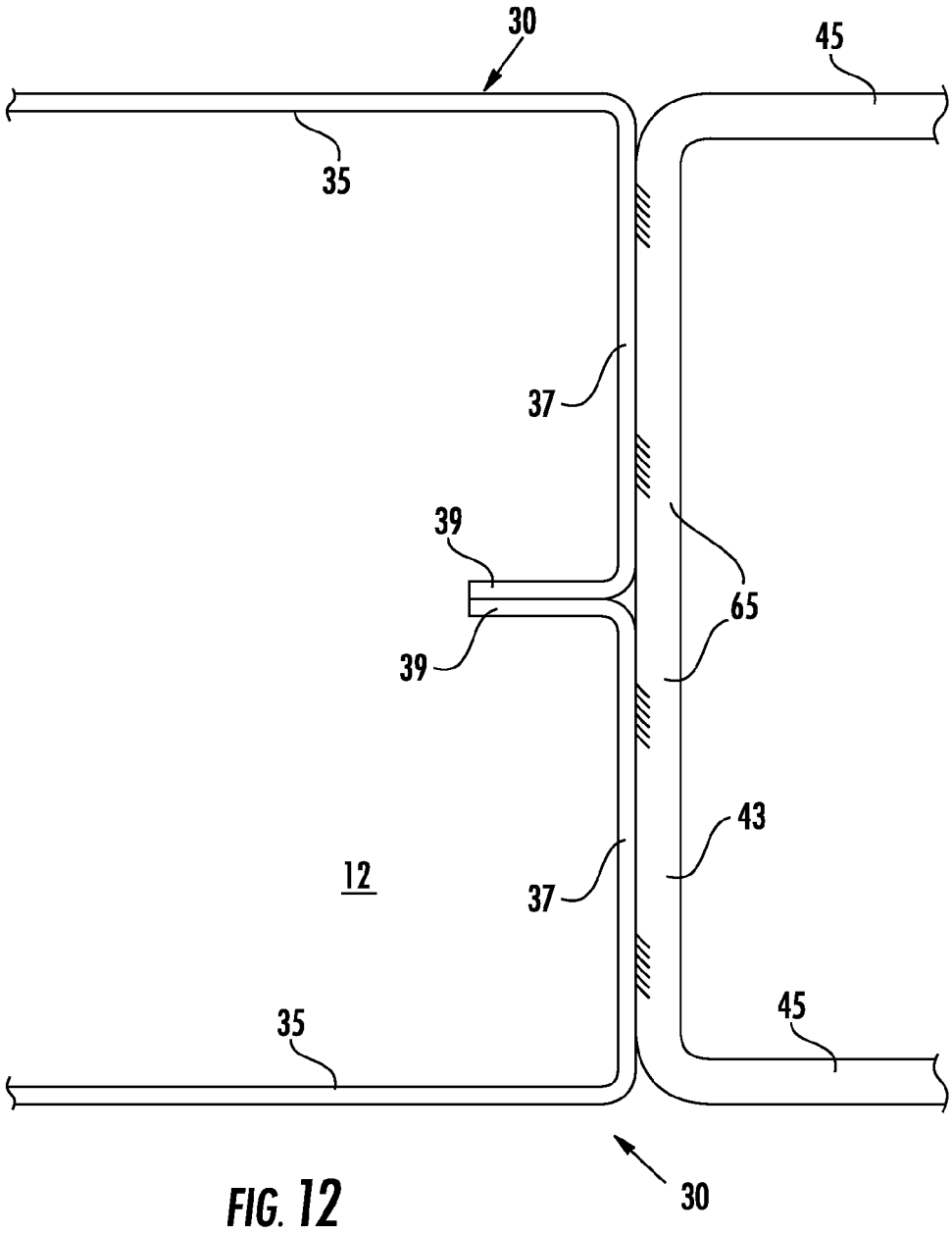
FIG. 12 is an enlarged end view of the end of the column of FIG. 10.

Referring additionally to FIGS. 10, 11, and 12, several detailed views are illustrated of the upper end 16 or 16' of columns 12 or 12', respectively. Since both columns and the upper ends are prepared in a similar fashion, only column 12 will be explained in detail. Further, as explained above, each column 12 includes two channels 30 with each channel 30 including a major wall 35, two side walls 36 and 37 extending perpendicular to wall 35 from opposite edges and flanges 38 and 39 extending inwardly toward each other perpendicular to side walls 36 and 37. Short sections of U-shaped attachment members 42 and 43 are affixed to side walls 36 and 37, respectively, at upper end 16 of each column 12. In this specific, example members 42 and 43 are attached to column 12 by pre-welding at the factory/shop with the U-shape opening outwardly to form four attachment flanges 45, one at each corner of column 12. In the preferred embodiment each U-shaped attachment member 42 and 43 is welded to upper end 16 of each column 12 by a plurality of spot or resistance welds designated 65. As illustrated, it is preferred that at least two spot welds 65 in a horizontal line are made to the outside of each surface 36 and 37 (four in a horizontal line) and a plurality (in FIGS. 10 and 11) four or five spot welds are made in vertical alignment. It has been found for example that a cluster of spot welds such as described can be made with one single weld head.

Figure 13:
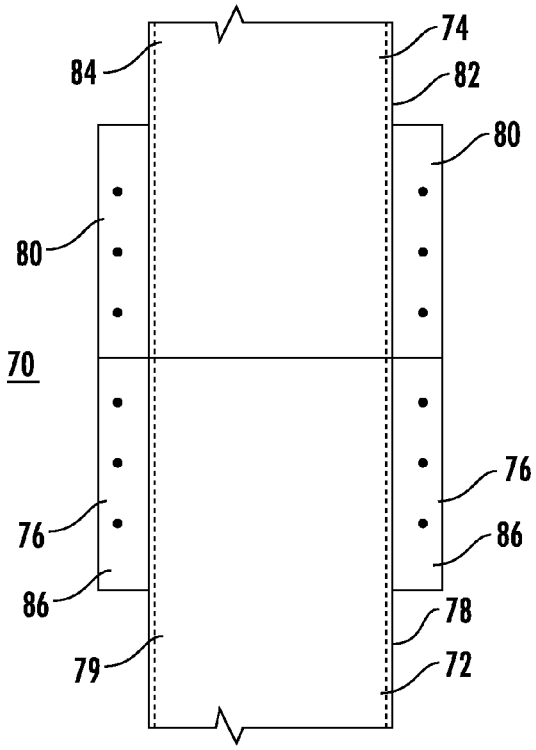
FIGS. 13, 14, and 15 illustrate long side, short side and end sectional views, respectively, of a column splice structure, in accordance with the present invention.
Figure 14:
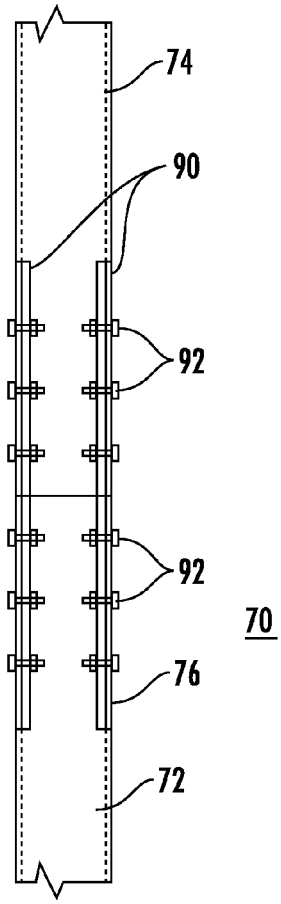
Figure 15:
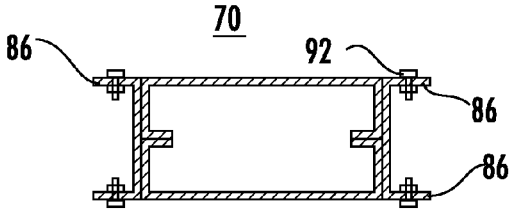

Turning to FIGS. 13, 14, and 15, several views of a column splice, designated 70, in accordance with the present invention are illustrated. In some structures (e.g. very tall structures) it may be desirable or even necessary to form the vertical columns into two or more sections so that each section can be easily handled by workers on the site. To this end column splice 70 can be used to mate a lower portion 72 of a column to an upper portion 74.

In this specific example, short U-shaped attachment members 76 are affixed to opposite side walls 78 and 79, respectively, of lower portion 72. Also, short U-shaped attachment members 80 are affixed to opposite side walls 82 and 84, respectively, of upper portion 74. In this specific, example each of the four members 76 and 80 are approximately 15 inches long and are attached to the column portions 72 and 74, respectively, by pre-welding at the factory/shop with the U-shape opening outwardly to form four attachment flanges 86, one at each corner of the column portions 72 and 74. U-shaped attachment members 42 and 43 may be preformed in the factory/shop in a manner and from materials similar to that described above for channels 30. For example, each U-shaped member has a major wall approximately 6 inches wide and side walls approximately 3 inches wide.

An elongated steel plate 90 is then bolted to the inner surface of each flange 86 by means of bolts 92. In this specific example, each of the four steel plates 90 are approximately thirty inches long by two and one half inches wide by five eighths inches thick. It will be understood that bolt holes for bolts 92 through steel plates 90 and mating holes through flanges 86 can most efficiently be drilled or otherwise formed in the factory/shop, however, they can be formed or drilled by the workers during assembly if preferred.

Figure 16:
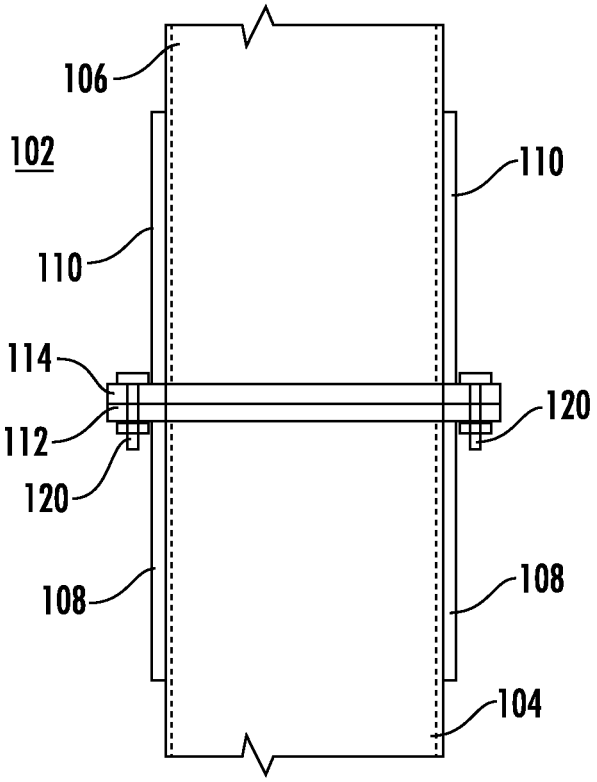
FIGS. 16 and 17 illustrate long side and end sectional views, respectively, of another column splice structure, in accordance with the present invention.
Figure 17:
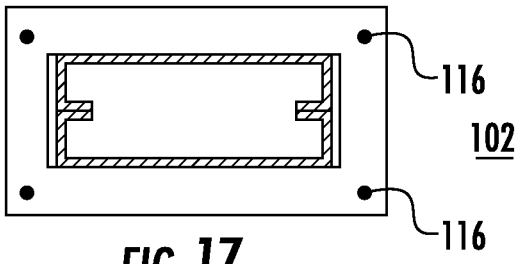

Turning to FIGS. 16 and 17, several views of another column splice, designated 102, in accordance with the present invention are illustrated. As explained above, in some structures (e.g. very tall structures) it may be desirable or even necessary to form the vertical columns into two or more sections so that each section can be easily handled by workers on the site. To this end column splice 102 can be used to mate a lower portion 104 of a column to an upper portion 106.

A steel plate 108 is affixed to each of the opposed short sides of lower portion 104 and similar steel plates 110 are affixed to the opposed short sides of upper portion 106 of the column. In this specific example, steel plates 108 and 110 all are approximately fifteen inches long, six inches wide and five eighths inches thick. Also steel plates 108 are formed with a collar 112 affixed to the upper edge thereof. Collar 112 extends completely around the upper end of lower portion 104 and, in this specific embodiment is approximately twenty one inches long by 12 inches wide by one and one fourth inches thick. Collar 112 is affixed to the upper ends of plates 108 by welding or the like. Similarly, steel plates 110 are formed with a collar 114 affixed to the lower edge thereof. Collar 114 extends completely around the lower end of upper portion 106 and, in this specific embodiment is approximately twenty one inches long by 12 inches wide by one and one fourth inches thick. Collar 114 is affixed to the lower ends of plates 110 by welding or the like. Both collars 112 and 114 have bolt holes 116 formed therethrough adjacent the corners thereof. The welds fixing collars 112 and 114 to plates 108 and 110, respectively are performed at the shop/factory. Also, it will be understood that bolt holes 116 through collars 112 and 114 can most efficiently be drilled or otherwise formed in the factory/shop, however, they can be formed or drilled by the workers during assembly if preferred. At the site bolts 120 are inserted through holes 116 to firmly splice lower portion 108 and upper portion 110 fixedly together into one continuous column.

Figure 18:
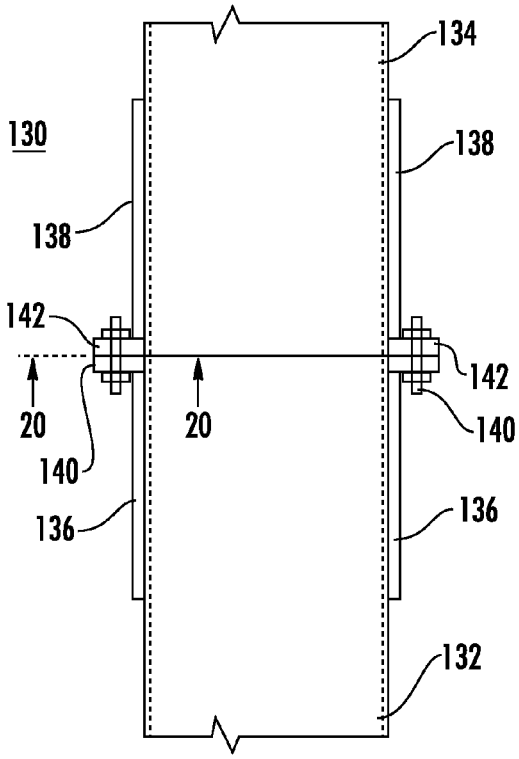
FIGS. 18 and 19 illustrate long side and end sectional views, respectively, of another column splice structure, in accordance with the present invention.
Figure 19:
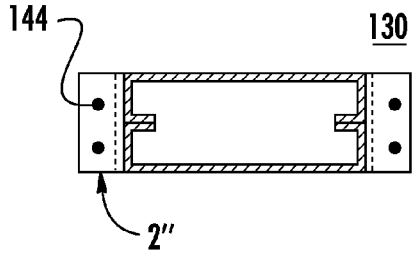
Figure 20:
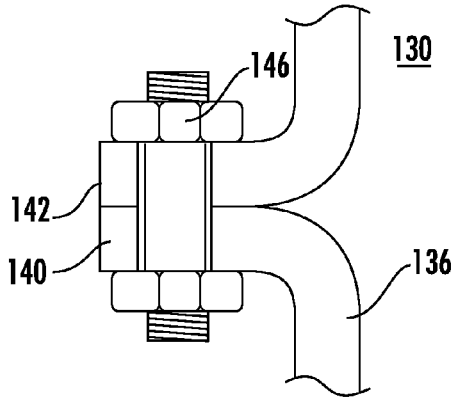
FIG. 20 is an enlarged sectional view of the bolt assembly as seen from the line 20-20 of the column splice structure of FIG. 18.
Figure 21:
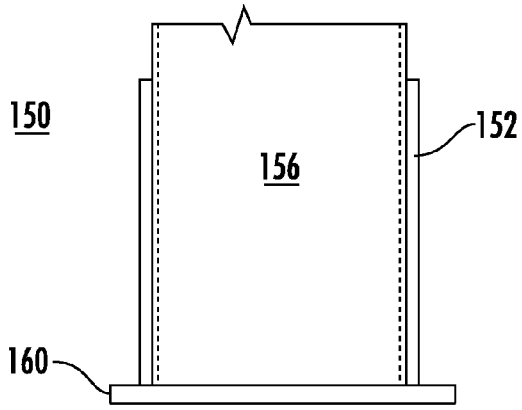
FIGS. 21 and 22 illustrate long side and end sectional views, respectively, of a column mounting structure, in accordance with the present invention.
Figure 22:
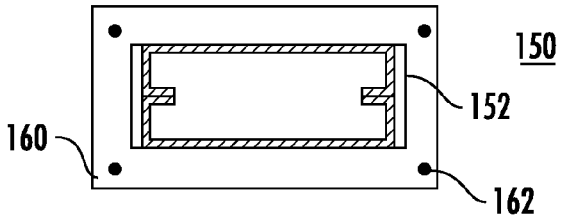
Figure 23:
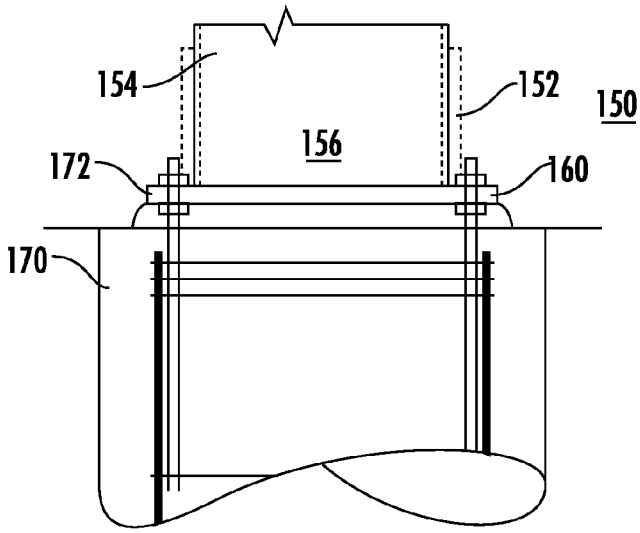
FIGS. 23 and 24 illustrate long side and end sectional views, respectively, of the column mounting structure of FIG. 21 in a mounted position, in accordance with the present invention.
Figure 24:
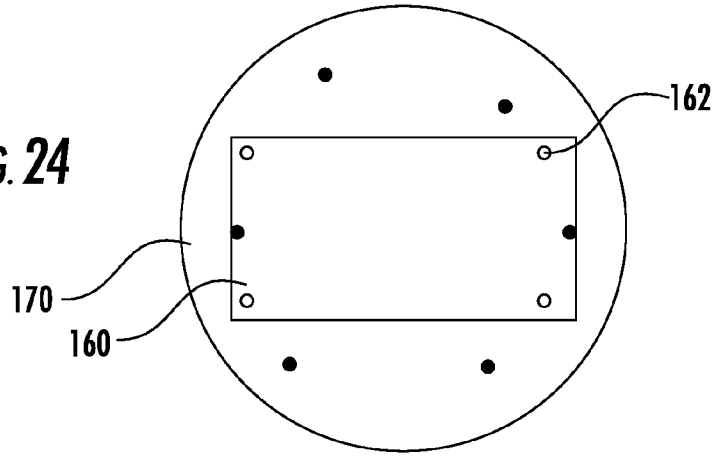

Turning to FIGS. 18, 19, and 20, several views of another column splice, designated 130, in accordance with the present invention are illustrated. As explained above, in some structures (e.g. very tall structures) it may be desirable or even necessary to form the vertical columns into two or more sections so that each section can be easily handled by workers on the site. To this end column splice 130 can be used to mate a lower portion 132 of a column to an upper portion 134.

A steel plate 136 is affixed to each of the opposed short sides of lower portion 132 and similar steel plates 138 are affixed to the opposed short sides of upper portion 134 of the column. In this specific example, steel plates 136 and 138 all are approximately fifteen inches long, six inches wide and five eighths inches thick. In addition, each of the two lower steel plates 136 has an outwardly directed flange 140 extending the length of the upper edge and each of the two upper steel plates 138 has an outwardly directed flange 142 extending the length of the lower edge. Each flange 140 and 142 has a pair of bolt holes 144 formed therein and when upper portion 138 is aligned with lower portion 136 bolt holes 144 in the flanges are aligned so that bolts 146 can be inserted and tightened to firmly splice lower portion 136 and upper portion 138 fixedly together into one continuous column.

Turning now to FIGS. 21 through 24, a column mounting structure 150 is illustrated in accordance with the present invention. A steel plate 152 is affixed to each of the opposed short sides of the lower end 154 of a column 156. In this specific example, steel plates 152 are approximately fifteen inches long, six inches wide and five eighths inches thick. Steel plates 152 are formed with a collar 160 affixed to the lower edges thereof. Collar 160 extends completely around the lower end of column 156 and, in this specific embodiment is approximately twenty one inches long by 12 inches wide by one and one fourth inches thick. Collar 160 is affixed to the lower ends of plates 152 by welding or the like at the shop/factory. Four mounting holes or anchor rod receiving apertures 162 are formed in collar 160. In the column mounting procedure a pier 170 is formed in the earth with anchor rods 172 fixedly implanted therein. Here it will be understood that the "earth" is any desired mounting area provided to support the structure. Column 156 is then positioned over pier 170 with anchor rods 172 extending upwardly through apertures 162. Nuts are threaded onto anchor rods 172 and tightened to firmly position affix collar 160 to pier 170 and firmly hold column 156 in the vertical upright position.

Thus, it will be understood that the new and improved flat roof structure can be easily bolted together at the site and does not require any on-site welding or any special tools. All welding, and bolt holes if desired, can be performed off-site at the shop/factory prior to transportation of the components to an assembly site. At the site the workers or construction people only need to bolt components together so that assembly requires a minimum amount of work and time. Also, in instances where components may be too large to transport conveniently (e.g. vertical columns) smaller components can be formed and then assembled with a minimum of effort at the site.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A flat roof support structure including a plurality of vertical columns each having a rectangularly shaped cross-section, an elongated generally horizontally oriented beam associated with and positioned atop each vertical column, and attachment structure fixing the upper end of each vertical column to a mounting area of the associated elongated beam, the attachment structure for each vertical column and associated elongated beam comprising:

two U-shaped attachment members one each affixed to opposed sides of the vertical column at the upper end of the vertical column, each of the two U-shaped attachment members opening in an outwardly directed orientation parallel to the elongated beam;

a pair of attachment plates fixedly attached one each to opposed sides of each elongated beam in the mounting area, the attachment plates extending downwardly below a lower surface of the elongated beam on opposed sides of the elongated beam a distance equal to a portion of the U-shaped attachment members, the attachment plates overlapping the portion of the U-shaped attachment members with the mounting area of the associated elongated beam positioned atop the vertical column, the two attachment plates being fixedly attached one to each opposed side of the associated elongated beam in the mounting area to form a solid channel or box into which the upper end of the vertical column is inserted; and attachment devices fixing the pair of attachment plates to the U-shaped attachment members and assembled on-site.

2. The flat roof support structure as claimed in claim 1 wherein each vertical column of the plurality of vertical columns includes two elongated channels affixed together in abutting relationship.

3. The flat roof support structure as claimed in claim 2 wherein each of the two elongated channels include a major wall extending the length of the channel, two side walls extending perpendicular to the major wall from opposite edges, and flanges extending inwardly toward each other perpendicular to the side walls, the two elongated channels being affixed together by affixing the flanges in abutting relationship.

4. The flat roof support structure as claimed in claim 1 wherein each vertical column of the plurality of vertical columns includes a plurality of elongated sections affixed in an end-to-end relationship by a column splice assembled on-site.

5. The flat roof support structure as claimed in claim 1 wherein each vertical column of the plurality of vertical columns includes a column mounting structure affixing a lower end of each vertical column to a mounting base or earth, the column mounting structure being assembled on-site.

6. A flat roof support structure comprising:

a plurality of vertical columns, each vertical column including two elongated channels affixed together in abutting relationship to define a rectangularly shaped cross-section;

an elongated generally horizontally oriented beam associated with each vertical column of the plurality of vertical columns;

U-shaped attachment members affixed to opposed sides of each vertical column of the plurality of vertical columns at an upper end of each column, the attachment members opening in an outwardly directed orientation parallel to the associated elongated beam;

a pair of attachment plates fixedly attached one each to opposed sides of each elongated beam in a mounting area of the elongated beam, the attachment plates extending downwardly below a lower surface of the elongated beam on opposed sides of the elongated beam a distance equal to a portion of the U-shaped attachment members so as to overlap the portion with the elongated beam positioned atop the associated vertical column, the two attachment plates being fixedly attached one to each opposed side of the elongated beam in the mounting area to form a solid channel or box into which the upper end of the associated vertical column is inserted; and attachment devices fixing the pair of attachment plates to the U-shaped attachment members and assembled on-site; and a plurality of elongated purlins affixed to an upper surface of the elongated generally horizontally oriented beams and positioned to extend longitudinally in parallel spaced apart relationship to substantially define a roof area.

7. A method of providing and assembling a flat roof support structure including the steps of:

providing a plurality of vertical columns, each column having a rectangularly shaped cross-section;

providing an elongated generally horizontally oriented beam associated with and adapted to be positioned atop each vertical column, each beam having a rectangularly shaped cross-section; and affixing two U-shaped attachment members to opposed sides of each of the vertical columns at the upper end of each column, the two U-shaped attachment members each opening in an outwardly directed orientation parallel to the associated elongated beam;

affixing a pair of attachment plates to opposed sides of each elongated beam in a mounting area, a portion of each of the attachment plates extending downwardly below a lower surface of the elongated beam a distance equal to a portion of the U-shaped attachment members so as to form a solid channel or box into which the upper end of the associated vertical column is inserted;

assembling on-site the plurality of vertical columns and the associated generally horizontally oriented beams by mounting each column of the plurality of vertical columns in an upright fixed orientation and positioning the associated beams with the mounting area above the upper end of the column so that the downwardly extending portion of the attachment plate forming the solid channel or box overlaps the portion of the U-shaped attachment members affixed to the upper end of the associated column; and using attachment devices affixing the overlapping portion of each of the pair of attachment plates to the portion of the U-shaped attachment members in the mounting area of each vertical column and associated generally horizontally oriented beam, whereby the beams and columns are fixedly attached on-site without welding.

8. A method as claimed in claim 7 wherein the step of providing a plurality of vertical columns includes the steps of providing two elongated channels and affixing the two channels together in abutting relationship to form each column of the plurality of columns.

9. A method as claimed in claim 8 wherein the step of providing two elongated channels includes forming each of the channels with a major wall extending the length of the channel, two side walls extending perpendicular to the major wall from opposite edges, and flanges extending inwardly toward each other perpendicular to the side walls, and the step of affixing includes fixing the two elongated channels together by affixing the flanges in abutting relationship.

10. A method as claimed in claim 9 wherein the step of providing two elongated channels includes forming each of the channels from flat sheet metal.

11. A method as claimed in claim 7 wherein the step of providing elongated generally horizontally oriented beams includes the steps of providing two elongated channels and affixing the two channels together in abutting relationship to form each beam.

12. A method as claimed in claim 11 wherein the step of providing two elongated channels includes forming each of the channels with a major wall extending the length of the channel, two side walls extending perpendicular to the major wall from opposite edges, and flanges extending inwardly toward each other perpendicular to the side walls, and the step of affixing includes fixing the two elongated channels together by affixing the flanges in abutting relationship.

13. A method as claimed in claim 7 wherein the step of mounting each column of the plurality of vertical columns in an upright fixed orientation includes providing a column mounting structure and affixing a lower end of each vertical column to a mounting base or earth with the column mounting structure on-site.

14. A method as claimed in claim 7 wherein the step of providing the plurality of vertical columns includes providing a plurality of elongated sections for each vertical column and affixing the plurality of elongated sections for each vertical column in an end-to-end relationship using a column splice assembled on-site.

15. A method as claimed in claim 7 wherein the steps of providing the plurality of vertical columns, providing the elongated generally horizontally oriented beams, affixing U-shaped attachment members, and affixing at least one attachment plate are performed off-site.

16. A method as claimed in claim 7 including a step of attaching a plurality of elongated purlins to an upper surface of the elongated generally horizontally oriented beams, the plurality of elongated purlins being positioned to extend longitudinally in parallel spaced apart relationship to substantially define a roof area.

17. A method as claimed in claim 7 including a step of forming mating bolt holes off site in the U-shaped attachment members and the at least one attachment plate.

18. A method as claimed in claim 17 wherein the step of using attachment devices includes using bolts on-site in conjunction with the mating bolt holes.

* * * * *